US006484464B1

(12) United States Patent
Ochoa

(10) Patent No.: US 6,484,464 B1
(45) Date of Patent: Nov. 26, 2002

(54) FLOOR AND ROOF STRUCTURES FOR BUILDINGS

(75) Inventor: Carlos M. Ochoa, Dallas, TX (US)

(73) Assignee: ICOM Engineering Corporation, Dallas, TX (US)

( * ) Notice: Subject to any disclaimer, the term of this patent is extended or adjusted under 35 U.S.C. 154(b) by 0 days.

(21) Appl. No.: 09/707,657

(22) Filed: Nov. 7, 2000

Related U.S. Application Data

(63) Continuation-in-part of application No. 09/389,163, filed on Sep. 2, 1999, now Pat. No. 6,250,361, which is a continuation-in-part of application No. 09/263,684, filed on Mar. 5, 1999, now Pat. No. 6,082,429, which is a continuation-in-part of application No. 09/116,689, filed on Jul. 16, 1998, now Pat. No. 5,954,111, which is a continuation-in-part of application No. 08/787,472, filed on Jan. 22, 1997, now abandoned.

(51) Int. Cl.[7] ..... E04B 1/18
(52) U.S. Cl. ..... 52/414; 52/745.03; 249/211
(58) Field of Search ..... 52/340, 414, 745.05; 249/211, 28

(56) References Cited

U.S. PATENT DOCUMENTS

| | | | | |
|---|---|---|---|---|
| 2,251,967 | A | | 8/1941 | Yoder |
| 2,284,898 | A | * | 6/1942 | Hartman |
| 3,818,083 | A | | 6/1974 | Butts et al. |
| 3,845,594 | A | | 11/1974 | Butts et al. |
| 3,979,868 | A | | 9/1976 | Butts et al. |
| 4,700,519 | A | * | 10/1987 | Person et al. |
| 4,865,486 | A | * | 9/1989 | Bettigole et al. |
| 5,373,679 | A | | 12/1994 | Goleby |
| 5,509,243 | A | * | 4/1996 | Bettigole et al. |
| 5,544,464 | A | | 8/1996 | Dutil |
| 5,927,036 | A | | 7/1999 | Matthews et al. |
| 6,094,883 | A | * | 8/2000 | Atkins |
| 6,282,862 | B1 | * | 9/2001 | Weeks |

FOREIGN PATENT DOCUMENTS

| | | |
|---|---|---|
| FR | 551659 | 4/1923 |
| RU | 1263386 A1 | 10/1986 |
| RU | 1755995 A1 | 8/1992 |

* cited by examiner

*Primary Examiner*—Blair M. Johnson
(74) *Attorney, Agent, or Firm*—Browning Bushman P.C.

(57) ABSTRACT

A horizontal floor or roof structure having a plurality of spaced parallel joists each joist having a vertical web with upper and lower flanges extending from the web. Each flange has a free edge with a tubular bead extending along each free edge and having an elliptical cross-section wherein the minor axis is at least 20% of the major axis. A floor or roof member is supported over said metal joist. A preferred method of forming a horizontal reinforced concrete wall structure for a building includes mounting a wire mesh material over the upper flanges of the joists, and pouring concrete in a flowing condition onto the concrete forms over the mesh material and over the upper flanges of the joists so that curing of the concrete provides a horizontal reinforced composite concrete wall structure.

7 Claims, 4 Drawing Sheets

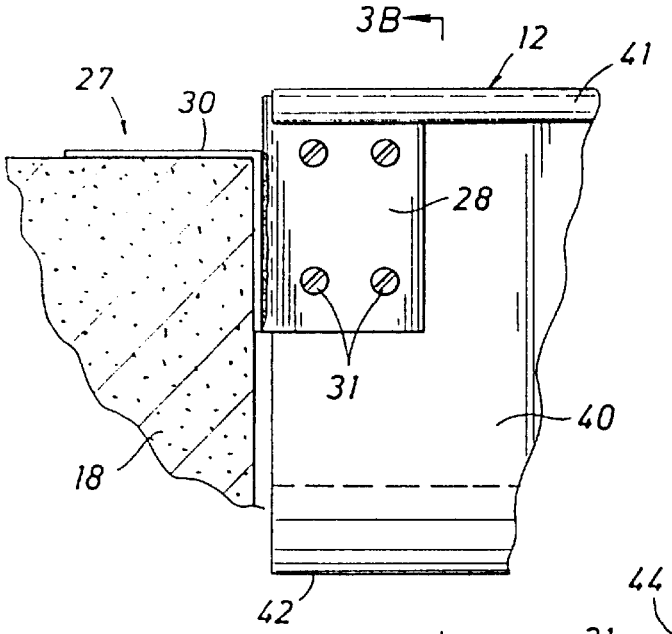
FIG. 3A
FIG. 3B
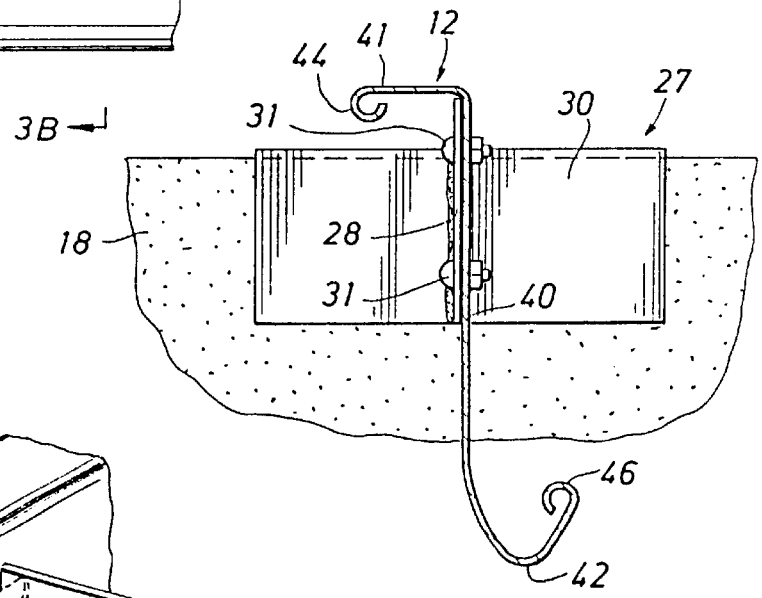
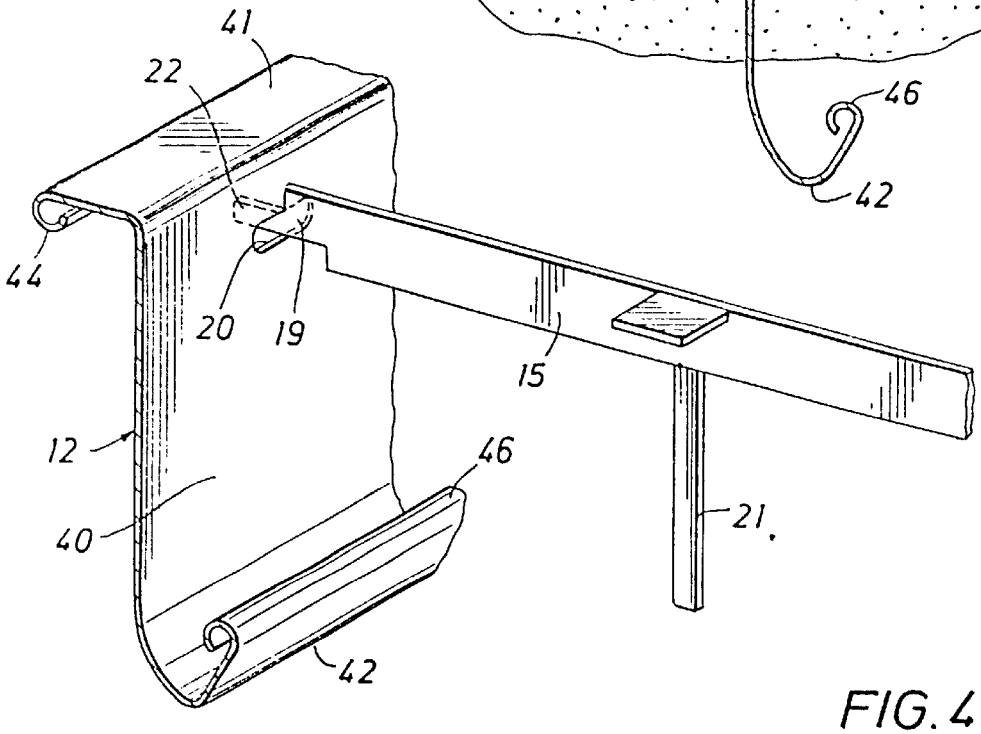
FIG. 4

FLOOR AND ROOF STRUCTURES FOR BUILDINGS

REFERENCE TO RELATED APPLICATIONS

This application is a continuation-in-part of application Ser. No. 09/389,163 filed Sep. 2, 1999; now U.S. Pat. No. 6,250 361, which is a continuation-in-part of application Ser. No. 09/263,684 filed Mar. 5, 1999, now U.S. Pat. No. 6,082,429 dated Jul. 4, 2000; which is a continuation-in-part of application Ser. No. 09/116,689 filed Jul. 16, 1998, now U.S. Pat. No. 5,954,111 dated Sep. 21, 1999, which is a continuation-in-part of application Ser No. 08/787,472 filed Jan. 22, 1997, now abandoned.

FIELD OF THE INVENTION

This invention relates generally to floor and roof reinforcing support structures for buildings, and more particularly to such a floor or roof structure utilizing a plurality of joists as integral parts of roof or floor sections such as a poured concrete slab composite construction.

BACKGROUND OF THE INVENTION

Over the past several years the need for stronger, lighter, less costly, and more durable roof and floor structures along with the need for more uniform materials has led to an ever increasing interest in steel joists and reinforcing members for floors and roofs. While various built-up, sheet metal and open truss shapes have been tried with various levels of success, few have met the criteria of manufacturing simplicity, flexibility for piping and electrical access, as well as ease in installation.

The flooring and roofing systems of buildings are complex integrated systems of components that must act together in a reliable and cost-effective manner during transportation, installation, and in service, where modifications are sometimes common.

One common approach taken by the building products industry to address these diverse needs is that of welded-member truss sections. These trusses are usually welded combinations of steel L-angle and round bar components. While these steel trusses can provide fairly good access for electrical and tubing routing needs, they are labor-intensive and require often-complex quality control measures associated with the weldment that are an integral part of their manufacture. As a result, they can be costly for a builder to specify. In addition, the stock must often be ordered to "exact length," since any required modifications at the job site may be difficult and involved. This has led to quite restricted use of these trusses, especially in the residential building marketplace for truss lengths generally under 20 feet.

Still other members have consisted of thin sheet metal webs reinforced by angles as top and bottom chord or flange members. However, these have not gained wide acceptance for various reasons including the following. First, the top and bottom angle members are usually thicker than the web member, making welding without excessive imperfections in the thin sheet a difficult process. In addition, the welded portions are located in relatively high stress regions, and may be weakened by corrosion, since welding usually removes any pre-existing corrosion protection coatings. Furthermore, the nesting required for efficient stacking and transportation is an especially difficult problem, since these sections are easily damaged during transport and installation.

Still other approaches have included various wood I-beam built-up trusses where the top and bottom chords are glued or mechanically fastened to a web member. While these trusses are quite flexible and simple to install for intermediate applications, they are of limited utility for longer spans. Furthermore, they do not lend themselves for use in composite flooring systems because they lack the strength and rigidity to be integrated adequately with concrete aggregates.

While thin sheet metal hat-shaped Z-shaped, and C-channel cross-sections have been considered, these sections have some inherent disadvantages. One of these disadvantages is that these truss members or joists have a "blade edge." This edge is very susceptible to imperfections in the sheet metal along this edge as well as to damage during manufacture, shipping/handling and installation. These imperfections along the blade edge become stress concentration points or focal points at which failure of the truss or joist can initiate. A more detailed description of this failure initiation follows.

Even the most perfect, smooth edge of the conventional sheet metal truss member or joist will experience a very localized point of high stress gradient due to the characteristic edge stress concentration associated with open sections under bending loads. Thus, initiation of an edge "bulge" or "crimp" on a perfect smooth edge is nothing more than the creation of an edge imperfection that is large enough to grow or "propagate" easily. It is significant that this stress concentration may be made worse by the presence of any relatively small local edge imperfections, even those on the order of size of the thickness of the truss member material itself These imperfections near the edge can be in the form of edge notches, waviness (in-plane or out-of-plane), local thickness variations, local residual stress variations, or variations in material yield strength. Where multiple imperfections occur together, they may all compound together to further increase the stress concentration effect, and thus lower the wind load level at which failure is initiated. Thus, the existence of any edge imperfections in a conventional truss member has the effect of enhancing an already established process of failure initiation.

Second, these truss members or joists, when manufactured out of relatively thin sheet metal are more susceptible to buckling due to the reduced thickness. Buckling is an instability in a part of the truss member associated with local compressive or shear stresses. Buckling can precipitate section failure of the truss member. For example, in a Z-section truss member with edge lips on the flange edges, when the top and bottom flanges are non-uniformly stressed, the result can be a kinking of the edge in the form of a crimp or buckle. This crimping can lead to complete failure of the section.

Finally, some thinner conventional truss members can experience "rolling" when placed under load. Rolling is when the shear stresses within the truss member results in a net torque about the centroid. of the thin walled cross-section thus causing the cross-section to twist possibly making the truss member unstable. Some manufacturers have increased the cross-sectional length of the flanges of the conventional C-channel stiffener or joist member trying to solve the rolling problem but were met with only marginal improvement. This is because the increased flange length had the simultaneous effect of increasing the distance from the centroid to the shear center of the channel. Additionally, increasing the cross-sectional flange length caused difficulty in accessing the fasteners used in mounting the C-channel to the rest of the integrated structure.

Because of diverse market requirements, the need for a simple, scalable, and reliable truss member, and the problem of joining relatively thick sections to sections relatively less thick, there is a need within the industry today for a versatile new lightweight/lower cost truss or joist configuration that can address all of the above-mentioned drawbacks and short comings of the present state of the art, is suitable for use with substantially all standardized building methods, and can be made on a cost-effective basis.

SUMMARY OF THE INVENTION

The present invention alleviates and overcomes the above-mentioned problems and shortcomings of the present state of the art through a novel lightweight/lower cost joist member. The novelty and uniqueness of this invention is that it: 1) is made of thinner material to reduce the in-plane stresses found in the fastener or joint area when it is integrated with other structures, 2) resists deflection adequately to meet stringent building code requirements, 3) is resistant to buckling and rolling, 4) effectively addresses edge stress concentrations by modifying the blade edge to an area of relatively low stress, and 5) can be manufactured cost effectively by using conventional manufacturing methods such as roll forming.

This novel invention may be described as a substantially reconfigured or stabilized J-section sheet metal truss having a mounting or integrating flange. It should be noted here that due to their extreme susceptibility to rolling, conventional J-section sheet metal joist members are seldom used in buildings. The unexpectedly strong synergisms of the unique characteristics found in the present stabilized J-section truss not only address the above problems, but simultaneously obtain material savings. More particularly the synergisms may be described as follows.

The instant invention has substantially redistributed material at critical locations as compared with conventional metal truss configurations. This material redistribution has the effect of altering considerably the behavior of the truss as compared with conventional J-sections and other truss configurations. The material redistribution required to accomplish these collaborative effects is accomplished by having specifically placed free edge portions, which are turned to define tubular beads or curls along the free edges. Moreover it is not just the presence of the tubular bead or curl that enables the substantial level of synergism, but the discovery of specific ratios of curl diameter to other truss member dimensions that maximize these synergisms even to the extent of obtaining significant weight or cost savings.

Two sets of significant synergisms combine to make the present invention successful. The first set of synergisms is directly related to the ratio of the diameter of the curl to the truss section flange length and web length. Each tubular bead has a cross-sectional dimension which when combined in specific ratios with other truss member dimensions substantially maximizes the moment of inertia of the overall section about the horizontal and vertical axes with a minimal use of material. Moreover, the tubular bead size specified by these same ratios has the effect of altering the characteristic failure mode normally associated with the free edge stress concentration for conventional steel truss members as described above. Finally, the cross-sectional dimension of the tubular beads of the stabilized J-section truss member make this novel truss member less sensitive to edge imperfections and damage because the blade edge has now been placed in a position of relatively benign stress levels so that imperfections or damage to the tube or edge region must now be on the order of size of the diameter of the curl in order to have significant detrimental effect on the truss member section.

Having established the above ratios, a second set of synergisms was discovered by directly combining the above with specific ratios of the truss's cross-sectional web dimension to crosssectional flange dimension. The compounding effect of the first set of synergisms with this additional set of ratios makes the stabilized J-section truss member or joist more resistant to rolling and buckling and thus avoids the problems that plague deeper conventional truss members using thinner gauge material. Additionally, these compounding synergisms make this truss member unique in that stresses are now more evenly distributed in the flanges thus making the truss member more stable and less sensitive to dimensional imperfections. Because of these cooperative effects, the stabilized J-section truss member demonstrates its uniqueness and efficiency in using thinner gauge material to reduce in-plane stresses found in the fastener or joint area, thus allowing the composite floor or roof structure including concrete and steel joist members to work together as a cohesive system instead of as individual components.

When compared to conventional truss members on the market today, the stabilized J-section truss member uses substantially thinner material while obtaining better resistance to structural loads. Thus even though additional slit width (width of the sheet of material from which the truss is made) is required to reposition needed material, the use of thinner gauge material more than offsets the additional slit width, bringing overall material savings as high as 25% in many instances. This innovation in system configuration also represents a substantial cost savings for the manufacturer, since material cost is a substantial portion of total manufacturing costs for building hardware. Thus, this unique and novel truss member is very cost effective.

For manufacturing process cost efficiency, the tubular bead is preferably an open-section bead, meaning that the sheet metal is formed in an almost complete bend or curl, but the curl need not be closed at its outer edge, such as by welding. A closed section tubular bead would work equally well, at a slightly higher manufacturing cost.

This edge feature is discussed in more detail in the following paragraph. The joint or integration section curl and the trough curl are tubular features, preferably open-sections, that are made by shaping the free edges or edge marginal portions of the truss cross-sections into an elliptical, preferably circular (for manufacturing simplicity), cross-sectional shape. As used herein, a circular cross-section is considered to be a special case of an elliptical cross-section. The term "characteristic diameter" refers to a constant diameter in the case of a circle, while other elliptical shapes will have major and minor axes or diameters, with the major axis or diameter being the "characteristic diameter". Even though some configurations of a slightly non-circular elliptical shape may be more desirable in some applications, the circular cross-section is generally preferable, because it is simpler to manufacture, while still achieving the desired benefits to a significant degree.

It is important to contrast the edge curl approach against other possible edge treatment approaches by noting that the dimensional order of size effect related to imperfections or damages described above for the curl can not be achieved by simply folding the edge over, either once or multiple times, because in this case the characteristic dimension will be defined by the fold edge diameter and not by the length of overlap of the fold. This is because the overlap direction is transverse to the edge and quickly moves out of the peak stress region, and because the edge fold diameter defines the maximum distance over which the edge stresses may be effectively spread.

The elliptical or circular open-section tubular shape or "edge curl" is contrasted to tubular sections of rectangular cross-sectional shapes, including folded edges, and to open-section tubular shapes of softened corner rectangular cross-sectional shapes in that in general, the characteristic diameter will be defined in each of these other cases by the fold diameter or by the softened corner diameter nearest to the truss member edge, as opposed to the overall diameter of the edge curl section. It may be noted that in this context a rectangular cross-section with very softened corners is in effect an imperfect ellipse or circle. In some instances, quasi-elliptical or quasi-circular crosssections, imperfect ellipses, and imperfect circles, such as in the form of rectangular cross-sections with very softened comers may function adequately, but may also be more difficult to manufacture and will be less effective than a generally circular curl.

The resulting synergistic effect of the stabilized J-section truss member's material efficiency in obtaining the desired bending moment of inertia, the alteration of the characteristic failure mode, the reduction in sensitivity to edge imperfections and damage, resistance to buckling and rolling as well as the ability to spread stresses more uniformly, has the same degree of compounding advantage as some conventional truss or stiffener's compounding disadvantage of low resistance to buckling and rolling combined with sensitivity to relatively small edge or dimensional imperfections. Accordingly, it can now be appreciated by those versed in this art, that the novel stabilized J-section truss members of the instant invention provide a solution to the problems that the building truss member art that has sought in order to overcome the shortcomings associated with conventional sheet metal truss configurations available hitherto. In fact, the present truss member is even competitive with traditionally highly competitive open-section truss members that are composed primarily of welded rods and L-angle members. In this case the competitive edge obtained for shorter spans includes both weight and manufacturing cost, while for greater spans it consists primarily of significant manufacturing cost savings. In summary, the stabilized J-section truss of the present invention has mounting or integrating flanges that may be uniquely designed to be compatible with substantially all standard building member interfaces, thereby significantly reducing the number of truss member types that manufacturers must carry in their inventories and package. This permits a great variety of building needs and requirements to be met, and does so without major modification of other structural components.

The following description of the present invention may incorporate dimensions which are representative of the dimensions which will be appropriate for most commonly found building structures. Recitation of these dimensions is not intended to be limiting, except to the extent that the dimensions reflect relative ratios between the sizes of various elements of the invention, as will be explained where appropriate.

It is a object of this invention to provide joist members for a floor or roof structure for buildings with the joist member being formed of minimal steel material while providing necessary strength for the floor or roof structure.

It is a further object of this invention to provide a composite floor or roof structure formed of reinforced cement and integral joint members of a thin gauge material having upper flanges embedded in the concrete.

It is another object of this invention to provide integral one piece joist members in which upper and lower flanges of the joist members have free edges with tubular beads or curls formed on the free edges to stiffen the flanges. Other objects, features, and advantages of the invention will be apparent from the following specification and drawings.

BRIEF DESCRIPTION OF THE DRAWINGS

FIG. 3A is a side elevation view of the end support structure for an end of a J-section joint member;

FIG. 3B is a section taken generally along line 3B—3B on FIG. 3A;

FIG. 4 is an enlarged sectional view of a releasable securing structure for the end of a support bar for the lower plywood layer;

DESCRIPTION OF THE INVENTION

Figure 1:
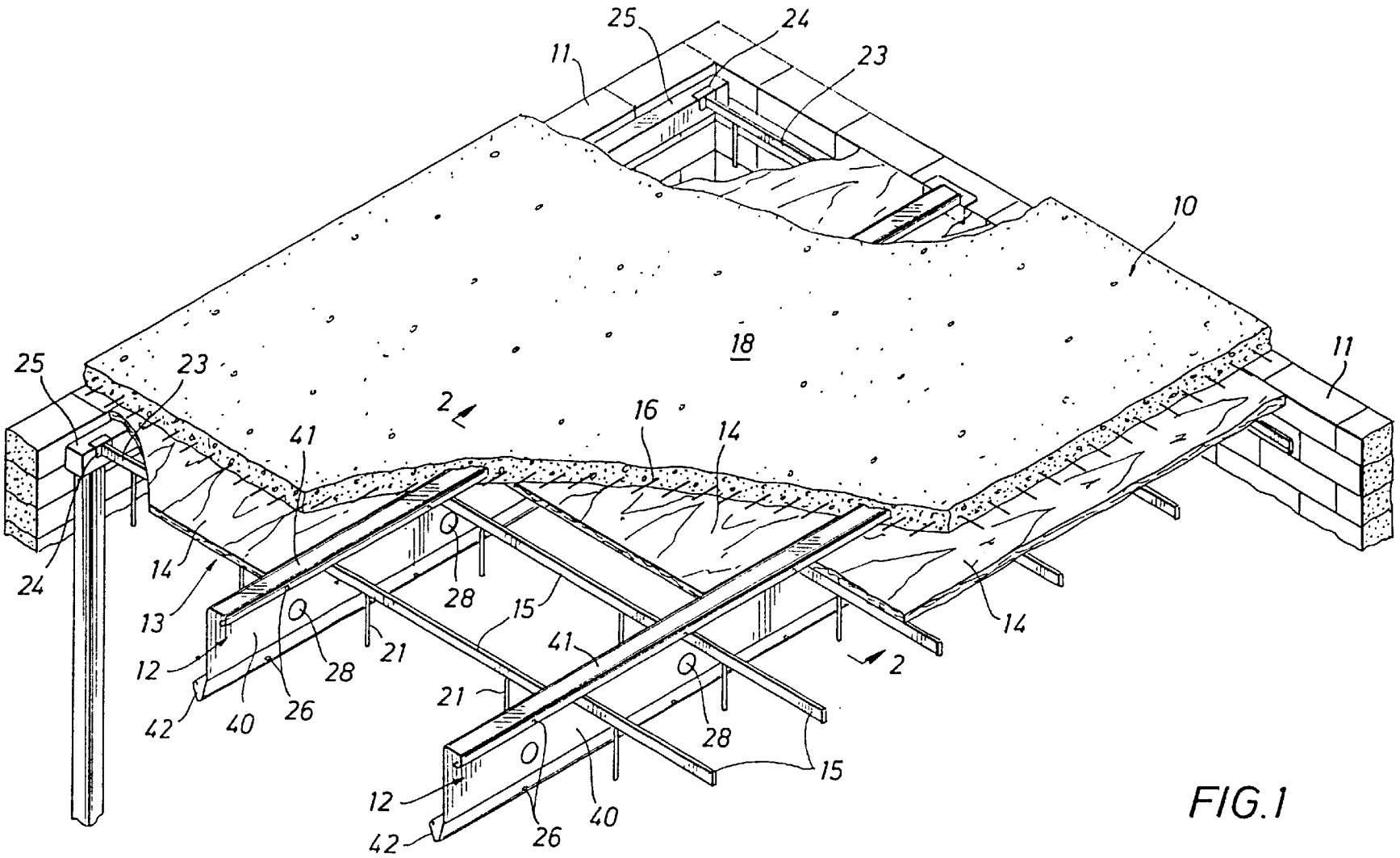
FIG. 1 is a perspective view of a section of a building floor or roof with stabilized J-section joist members of the present invention integrated with the slab for composite action of the combined slab and J-section joist members.
Figure 2:
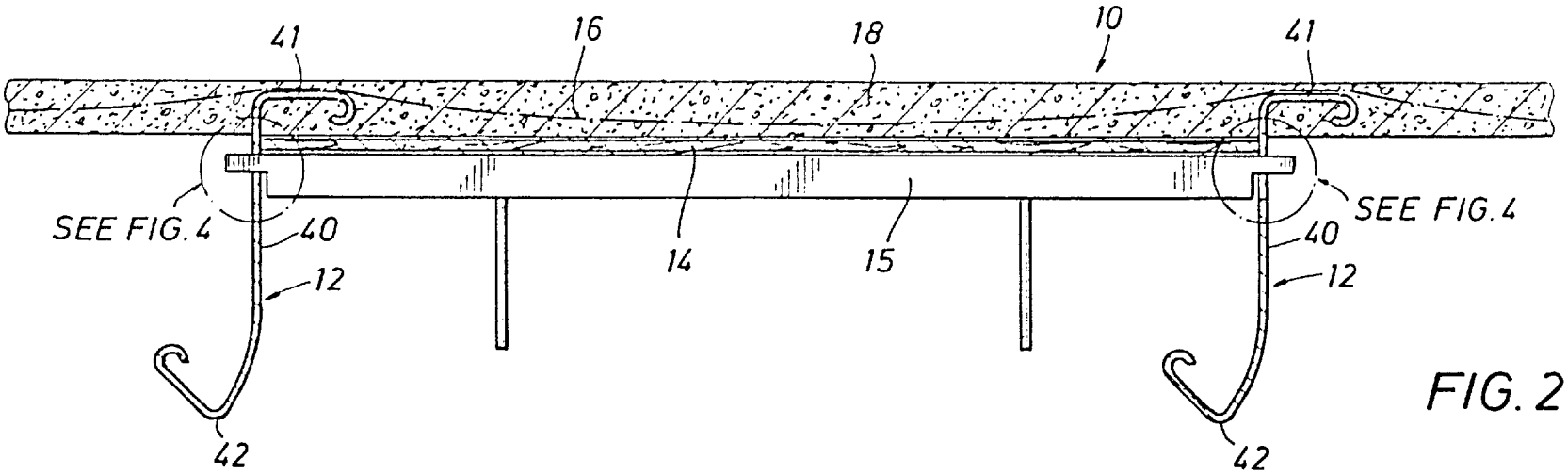
FIG. 2 is a transverse sectional view taken generally along line 2—2 of FIG. 1 showing the slab with a wire mesh material embedded into the slab and draped over the top flanges of the vertically extending J-section joist members.
Figure 5:
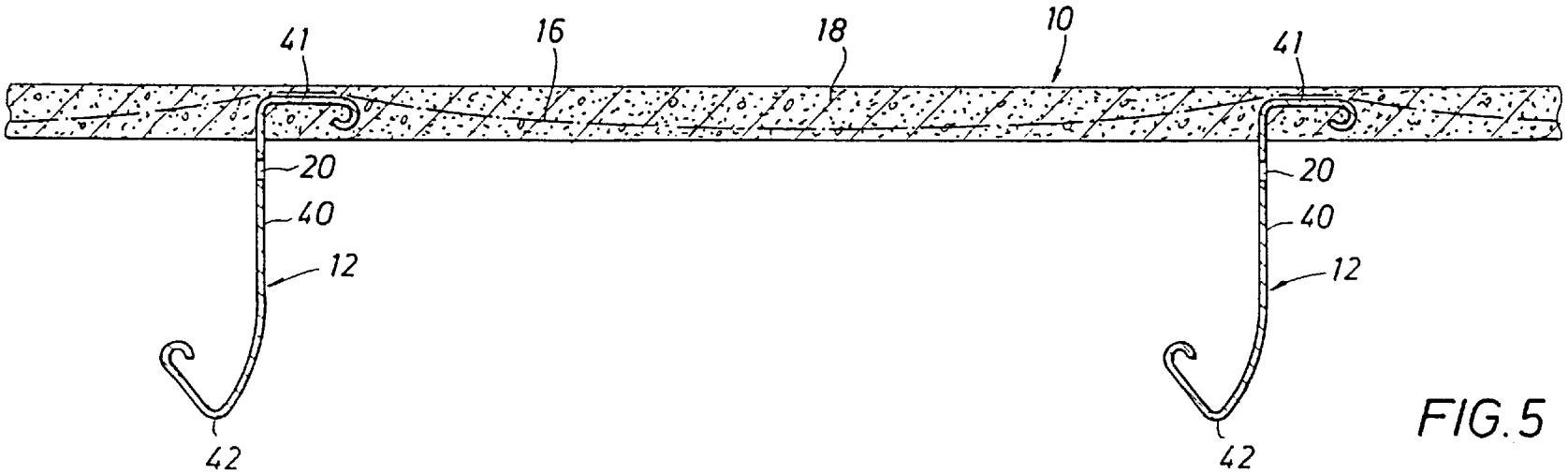
FIG. 5 is a transverse sectional view of the concrete slab, wire mesh material and J-section joist member with the lower plywood layer and support bars removed.

Referring to the drawings for a better understanding of the invention, and more particularly to FIGS. 1 and 2 of the embodiment shown in FIGS. 1–7, a horizontal reinforced concrete floor structure is generally indicated at 10 mounted on supporting walls 11. Floor structure 10 comprises a plurality of spaced parallel J-section joists or joist members indicated generally at 12 and extending longitudinally between opposed end walls 11. A lower floor layer 13 comprises plywood sheets or forms 14 supported on horizontal support bars 15 which are supported on joists 12. Support members 15 are mounted for being removed, if desired, as will be explained further.

A wire mesh reinforcing material 16 is mounted over the upper surfaces of joists 12 and concrete 18 supported on plywood layer 14 is poured over the wire mesh material 16 and over the upper portions of joists 12. The floor structure 10 is finished upon curing or setting of the concrete 18 after being screeded.

Each joist 12 comprises a vertical body or web 40, an integral horizontal mounting flange 41 at right angles to web 40 and an integral lower generally bowed flange 42. Upper flange 41 is normally embedded in concrete 18 between about 0.5 inch and 3.5 inch to allow the concrete aggregate to flow around upper flange 41 in order to establish good load transfer between upper flange 41 and the concrete aggregate after concrete 18 has been set. Concrete layer 18 is normally about 3 inches in thickness but may be substantially thicker. The wire mesh material 16 is draped or positioned over upper flanges 41 of joists 12 prior to the pouring of concrete 18.

In the event plywood forms 14 are desired to be removed after curing or setting of concrete 18, support members 15 as shown in FIG. 4 are made removable and have opposed ends 19 positioned in elongate openings 20 in vertical web 40 of joist 12. Openings 20 may be formed during the manufacture of joist 12 and positioned at the appropriate height to provide support and releasable locking for support members 15. Handles 21 are mounted on members and are utilized to rotate members 15 ninety (90) degrees to permit sliding of members 15 for removal of extending fingers 22 from elongate openings 20. Side members 23 adjacent side wall 11 have telescoping sections and angle 24 on the outer end of each side member 23 fits on adjacent structural support member 25 in supporting relation.

As shown in FIGS. 3A and 3B, a support shoe generally shown at 27 as mounted on end wall 11 to support the adjacent end of joist 12. Support shoe 27 includes an angle 30 having an extending support plate 28 secured thereto. Web 40 ofjoist 12 is secured by suitable bolt and nut combinations 31 to support plate 28.

Drain openings 26 are provided on upper and lower flanges 41, 42. Access openings 28 on web 40 are present to provide access to both sides of web 40. Additional transverse structural members (not shown) may extend between joists 12 at various predetermined positions.

Figure 6:
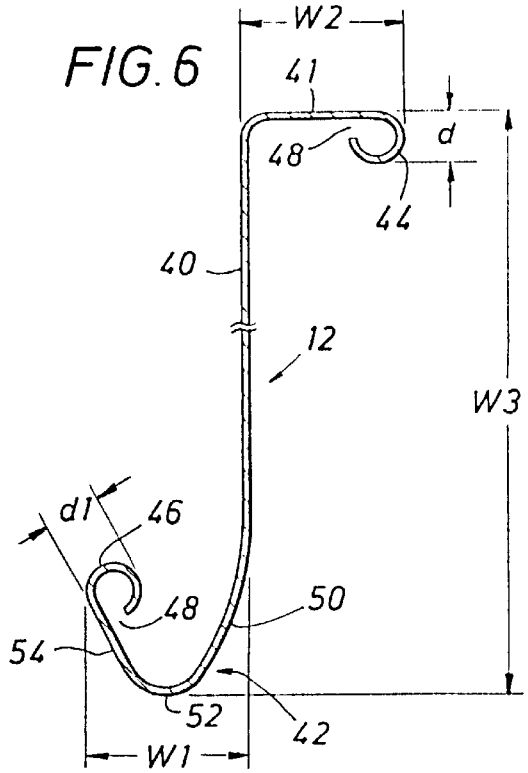
FIG. 6 is an enlarged sectional view of a joist member removed from the floor or ceiling structure.
Figure 7:
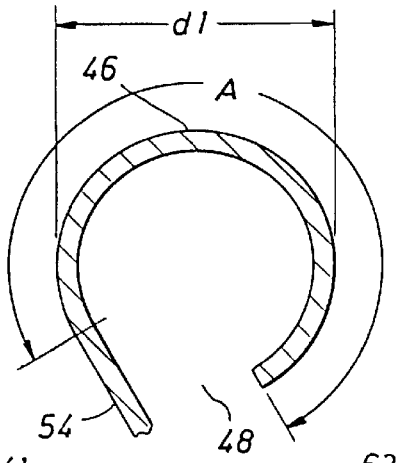
FIG. 7 is an enlarged sectional view of a tubular bead on the free end of a flange of the joist member of FIG. 6.

Joist member 12 may commonly be formed of a sheet material such as a steel alloy or other high stiffness material such as fiber reinforced composites. The thickness of joist 12 is between 0.055 inch and 0.140 inch. As previously indicated, joist or joist member 12 comprises vertical body or web 40, an integral horizontal mounting flange 41 at right angles to body 40, and an integral outer bowed flange 42. The opposed free edge portions of mounting flange 41 and bowed flange 42 are turned inwardly to form open-section tubular beads or edge curls 44 and 46. In some cases an open gap 48 is formed adjacent each tubular bead 44, 46. Tubular beads 44, 46 are shown as being of circular configurations or shapes in cross section and have outer diameters indicated at d and d1. Tubular beads 44, 46 are turned inwardly an angular amount A of at least 210 degrees and preferably about 270 degrees from the flange 41 and bowed flange 42 as shown in FIGS. 6 and 7 particularly. Thus, gap 48 is of an angular amount about 70 degrees. If desired, tubular beads 44, 46 could be closed or could consist of angular amounts A much greater than 360 degrees, although 270 degrees has been found to be optimum. An angular shape for beads 44, 46 as small as about 210 degrees would function in a satisfactory manner in most instances.

A tubular bead or curl of an elliptical cross-sectional shape has a major axis and a minor axis. Diameter or dimension d or d1 for an elliptical shape is interpreted herein for all purposes as the average dimension between the major axis and the minor axis. For an exact circular shape the minor axis and major axis are equal. The major and minor axes are at right angles to each other and defined as the major and minor dimensions of the open or closed tubular section. To provide an effective elliptical shape for tubular beads 44 and 46, the length of the minor axis should be at least about 20 percent of the length of the major axis. The terms "elliptical" shape and "elliptical" cross section are to be interpreted herein for all purposes as including circular shapes and circular cross sections. Preferably, diameter d1 for bead 46 is larger than diameter d for bead 44. Bowed flange 42 is generally bowl shaped and in some cases can include generally flat portions for the purpose of attaching or interfacing other related structural elements. It has an outwardly sloping wall portion 50 extending from vertical body 40 to a generally arcuate apex region 52. An integral sloping wall portion 54 extends from generally arcuate apex region 52 to bead 46. Note that the region between 40 and 46 may include flat portions or other features for the purpose of local strengthening or for attaching or accommodating other building members.

In order for tubular beads 44, 46 to provide maximum strength with a minimal cross sectional area of J-section joist 12, the diameter d1 of tubular bead 46 is selected according to the width W1 of bowed flange 42 as shown in FIG. 6. These ratios are somewhat more critical for tubular beads 46 than for tubular beads 44. A ratio of about 5 to 1 between W1 and d1 has been found to provide optimum results. A ratio of W1 to d1 of between about 3 to 1 and 8 to 1 would provide satisfactory results. A similar ratio between W2 and d for tubular bead 44 is used for some applications. As an example of a suitable J-section joist 12, W1 is 2 inches, W2 is 2 inches, and W3 is 8 inches. The diameter d for bead 44 is ½ inch and diameter d1 for bead 46 is ½ inch.

In order to obtain the desired minimal weight J-section joist, tubular curls or beads 44, 46 must be shaped and formed within precise ranges and sizes in order to provide maximum strength. For most applications these ranges are somewhat more critical for the lower flange. Using various design formulae to determine the outer diameters of tubular curls 44, 46, an optimum outer diameter of ½ inch was found to be satisfactory. However, it is generally preferred that diameter d1 for curl 46 be slightly larger than diameter d for curl 44. W1 and W2 Ware between about three (3) and five (5) times the outer diameter of tubular curls 44 and 46 for best results. Width W3 is between about two (2) and ten (10) times widths W1 and W2 for best results. By providing such a relationship between tubular curls 44, 46 and widths W1 and W2 the moment of inertia is maximized and edge stress concentrations are minimized for J-section joist 12 thereby permitting the light weight/low cost construction for joist member 10 of the present invention. It may be noted that in the case of joists having upper flange 41 embedded in concrete, the stresses near flange 41 can be somewhat lower than near lower flange 42. In this case the ratios related to tubular beads 46 may be somewhat more critical than for tubular beads 44 in obtaining various of the benefits of the present invention. When the upper flange is not embedded but is instead attached to the surface of floor or roof members, then the design ratios related to beads 44 and 46 can be equally important, depending upon installation details. Tubular curls 44, 46 are illustrated as turned inwardly which is the most desirable. In some instances it may be desirable to have a tubular curl turned outwardly.

Figure 8:
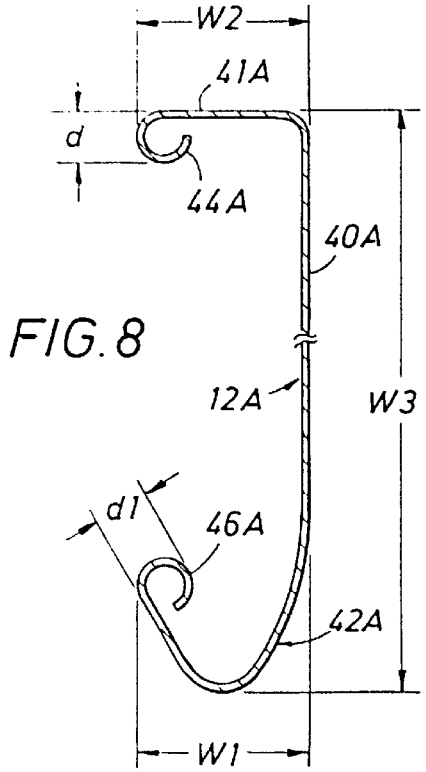
FIG. 8 is an enlarged section of a modified J-section joist in which the top or mounting flange extends in an opposite direction from the mounting flange for the embodiment of FIGS. 1–7.

FIG. 8 shows another embodiment of a J-section joist in which joist member 12A has a mounting flange 41A extending from body 40A in the same direction as outer bowed flange 42A. Tubular curls or beads 44A and 46A together with the dimensions shown at W1, W2, W3, d, and d1 are similar to the embodiment of FIGS. 1–7. The only change in the embodiment of FIG. 8 from the embodiment of FIGS. 1–7 is the direction in which mounting flange 41A extends.

Figure 9:
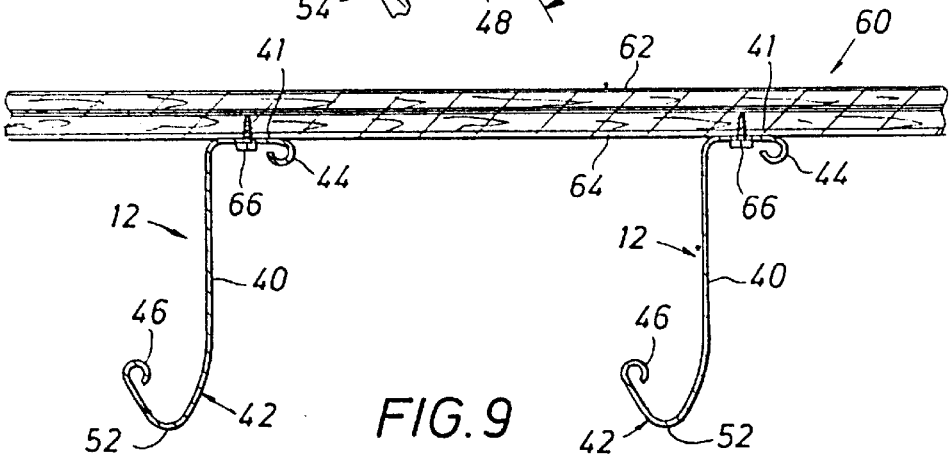
FIG. 9 is an enlarged section of a modified floor structure in which wooden flooring members are utilized.

FIG. 9 shows a further embodiment in which joist members 12 are utilized with a wooden subfloor section 60. Outer plywood layers 62 and 64 are secured to opposite sides of subfloor section 60. Metal fasteners 66 secure upper flanges 41 of joists 12 to wood subfloor section 60. Additional fasteners as desired may be added along the length of mounting flange 41 for mounting J-section joists 12 on wood subfloor section 60. The spacing of the joists and the fasteners on each joist member are chosen based upon the building load specifications and requirements.

Typical floor or roof spans without intermediate supports may generally range between ten (10) feet and about thirty (30) feet. Two examples are given below to highlight the advantages of the instant invention. One example is of a residential floor, and the other is of a commercial building floor. In both cases the truss or joist spacing that is used corresponds to actual conventional truss manufacturer's specifications and not to the most optimized configurations for the new J-section joists. This approach is taken in order to further highlight the advantages of the present invention over existing conventional cost-efficient designs.

The first example is a residential application involving a typical sixteen (16) ft span, a conventional joist might be used that is about nine (9) inches deep and is mounted to a three-quarter (¾) inch thick plywood subfloor on sixteen inch centers. The total load in this case is assumed to be sixty (60) psf In this case the equivalent J-section joist would also be nine (9) inches deep with a thickness of 0.075 inches and edge curls that are one half(½) inch in diameter. An allowable deflection of L/360 is used, where L is the span of the floor. When compared with typical conventional open-section trusses composed of welded round metal bars and L-angles, the weight saving of the new J-section joist member over the conventional truss member is about 25 percent. Moreover, in this case an additional cost saving of about 25 percent is possible. This is because of the high manufacturing labor and weld materials cost associated with the welded construction of the open-section truss versus the relatively low manufacturing cost of the new roll-formable J-section joist.

The second example is the case of a composite floor construction for a commercial building having a twenty (20) foot span with a four point one (4.1) foot spacing of the J-section joist members and a joist member depth of 12 inches where the top flange of the J-section joist member is embedded about seven eighths (⅞) of an inch into the three inch total depth concrete slab with reinforcing wire mesh, the new J-section joist may be made 0.096 inches thick with edge curls that are one half (½) inch in diameter. In this case a non-composite deflection ratio of L/360 and a composite action deflection ratio of L/360 are used, where the total composite-action loads are 100 psf and the total non-composite loads are 60 psf. It may be noted that in this case the composite action loads consist of a live load of 40 psf, a dead load of 20 psf, plus 40 psf for the weight associated with the three inches thickness of the concrete slab. It may also be noted that the noncomposite loads consist of the weight associated with the three inch thick concrete plus a 20 psf construction load that accounts for overpour of the concrete and for the weight exerted by workers before the concrete has set.

In this case the material saving over a conventional open-section truss composed of round metal bars and L-angles is very small. However, the total manufactured truss cost saving is very significant, at about thirty (30) percent. This is because of the high manufacturing labor and weld materials costs associated with the welded construction of the open-section truss versus the relatively low manufacturing cost of the new roll-formable J-section joist. Thus, in general the present invention has the potential for significant weight saving for spans of sixteen (16) feet or less. However, for spans that are generally over twenty (20) feet, it is the relative manufacturing costs that give the present innovations significant advantages over steel truss shapes that are presently available on the market.

As a result of providing the tubular beads or curls along the marginal edge portions of the J-section joist for spans of 16 feet or less, weight savings of generally about twenty five percent have been obtained for the present joist as compared with prior art steel trusses as utilized heretofore. For spans greater than about 16 feet, it is the manufacturing costs that provide significant total cost savings of the present joist as compared with prior art steel trusses as utilized heretofore. By utilizing precise tubular beads as set forth herein on the selected members where it is most needed for strength, a manufacturer may utilize an unexpectedly substantially thinner gauge material while eliminating or minimizing problems encountered heretofore by prior art designs of steel trusses, such as used in building structures.

It is apparent that the present invention as shown and described could be utilized with any horizontal concrete wall in a building including particularly horizontal floor and roof walls. One piece joists are utilized and various supports for the joists may be provided including separate transverse support beams or members between adjacent joists. Truss structures have been used heretofore which comprise a plurality of separate connected members.

While the particular invention as herein shown and disclosed in detail is fully capable of obtaining the objects and providing the advantages hereinbefore stated, it is understood that this disclosure is merely illustrative of the presently preferred embodiments of the invention and that no limitations are intended other than as described in the appended claims.

What is claimed is:

1. A horizontal concrete wall structure for a building comprising:

a plurality of spaced parallel metal joists supported at opposed ends thereof, each metal joist having a vertical web with upper and lower flanges extending outwardly therefrom, each lower flange having a free edge and a tubular bead extending along the free edge having an elliptical cross-section wherein the minor axis is at least 20% of the major axis, each lower flange being bowed and forming a trough between the bead and web of each joist;

a wire mesh reinforcing material mounted adjacent the upper flanges of said metal joists; and concrete surrounding the upper flanges of said metal joists and said wire mesh reinforcing material to form the horizontal concrete wall structure.

2. The horizontal concrete wall structure as defined in claim 1, wherein said concrete extends between about 0.5 inch and 3.5 inch in depth beneath the upper surface of the upper flanges of said joists thereby to firmly embed said upper flanges in said concrete, the upper flange having a free edge and a tubular bead extending along the free edge.

3. The horizontal concrete wall structure as defined in claim 1 further comprising a plywood layer beneath said concrete mounted between adjacent joists.

4. A horizontal wall structure for a building comprising:

a plurality of spaced parallel integral metal joists each having a vertical web with upper and lower flanges extending from the web, the lower flange having a free edge and a tubular bead extending along the free edge with each bead having an elliptical cross-section wherein the minor axis is at least 20% of the major axis, said lower flange being bowed and forming an upwardly opening trough between the bead and web of each joist; and at least one wall member secured onto said metal joists.

5. The horizontal structure as defined in claim 4 wherein the upper flange has a free edge and a tubular bead extending along the free edge, and the width of said lower flange and said upper flange is at least two times the outer diameter of said beads.

6. The horizontal structure as defined in claim 5 wherein said lower flange beads are inturned and extend in an exact circular path of at least 210 degrees.

7. A horizontal wall structure for a building comprising:

a plurality of spaced parallel integral metal joists each having a vertical web with upper and lower flanges extending from the web, the lower flange having a free edge and a tubular bead extending along the free edge with each bead having an elliptical cross-section wherein the minor axis is at least 20% of the major axis;

at least one wall member secured onto said metal joists, said wall member including at least one upper layer and a lower plywood layer secured to said upper layer; and fasteners securing said joists to said wall member.

* * * * *